United States Patent [19]

Hansel

[11] 4,027,708

[45] June 7, 1977

[54] DISPENSING NOZZLE CONTROL SYSTEM

[75] Inventor: William B. Hansel, Media, Pa.

[73] Assignee: Suntech, Inc., St. Davids, Pa.

[22] Filed: Apr. 1, 1976

[21] Appl. No.: 672,580

[52] U.S. Cl. ..... 141/209; 141/225

[51] Int. Cl.[2] ..... B65B 1/36

[58] Field of Search ..... 141/206, 209, 218–226

[56] References Cited

UNITED STATES PATENTS 3,101,102 8/1963 Gearhart et al. ..... 141/209

*Primary Examiner*—Stanley H. Tollberg
*Assistant Examiner*—Hadd Lane
*Attorney, Agent, or Firm*—Donald R. Johnson; J. Edward Hess

[57] ABSTRACT

A control system for a gasoline dispensing nozzle which includes a locking system for placing the nozzle in an inoperative mode once the nozzle automatically shuts off. Resetting of the locking system is then required before operation of the nozzle can again be commenced. The locking system includes a biased member which maintains the automatic shut-off system in its disabling mode once it disables the nozzle. This locking system is designed primarily for use on a dispensing nozzle with a vapor receiving system and is used to discourage an operator of the nozzle from overfilling a gasoline tank, which results in increasing the risk of spilling gasoline or forcing gasoline back through the vapor return line. An alternative embodiment using magnetic locking means is also provided.

9 Claims, 11 Drawing Figures

FIG.3.
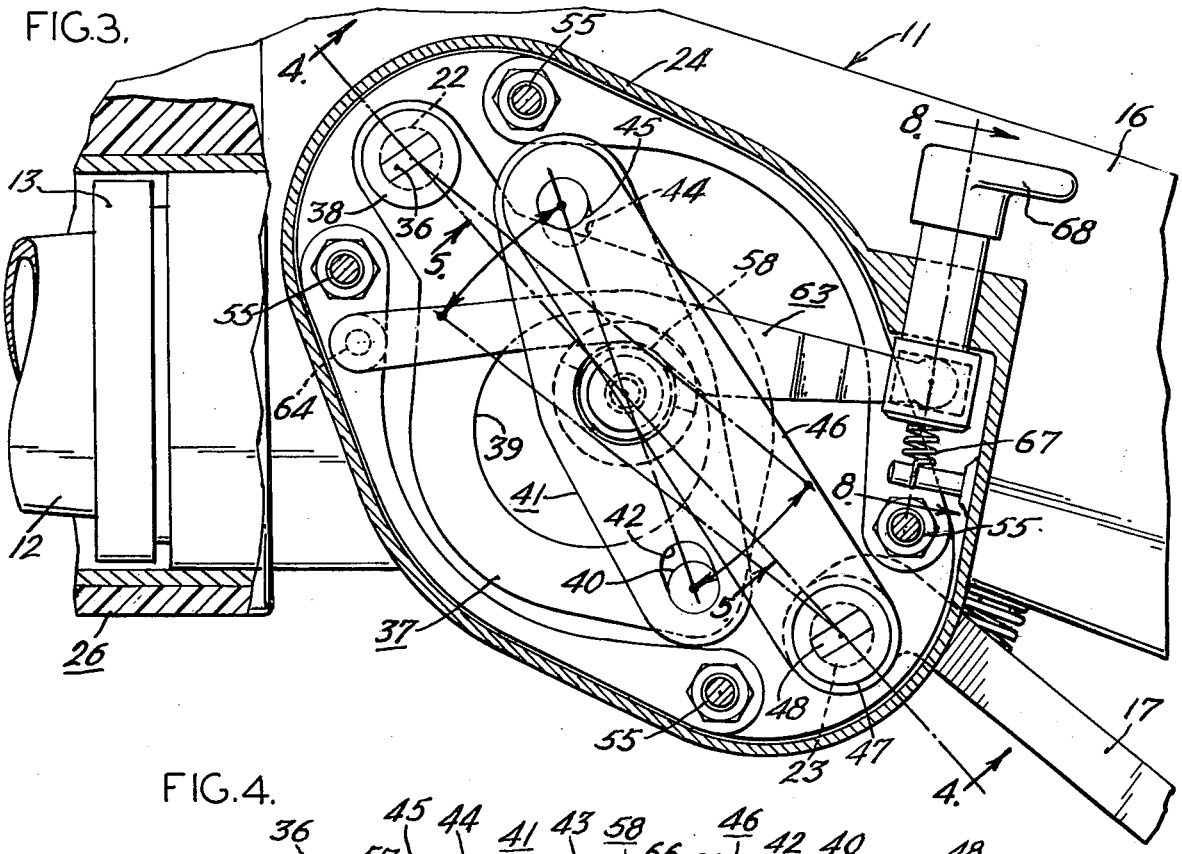
FIG.4.
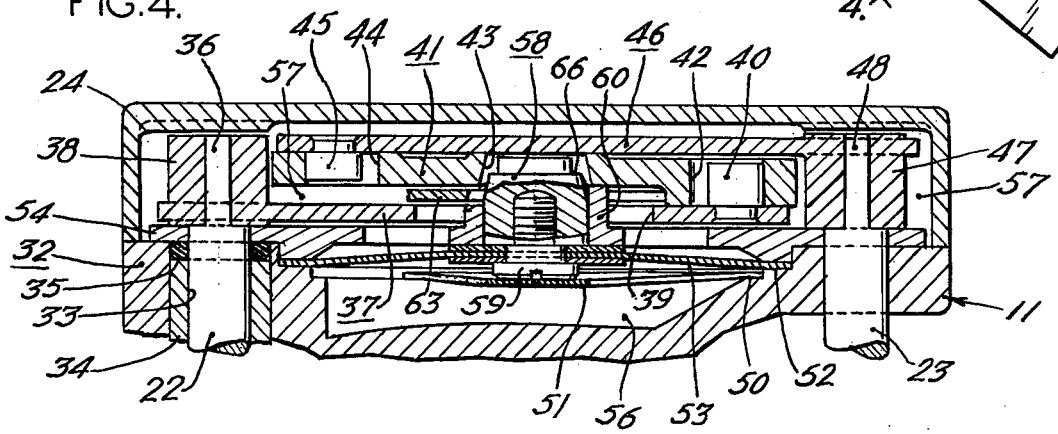
FIG.5.
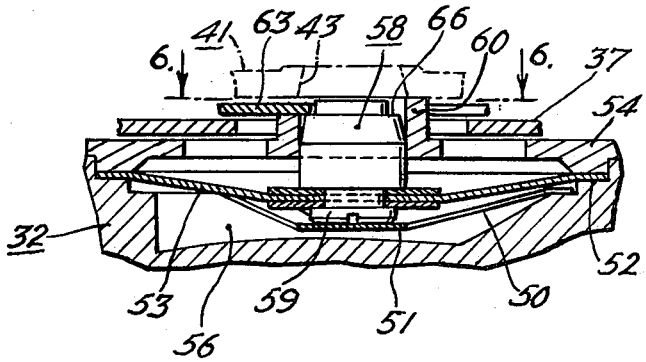
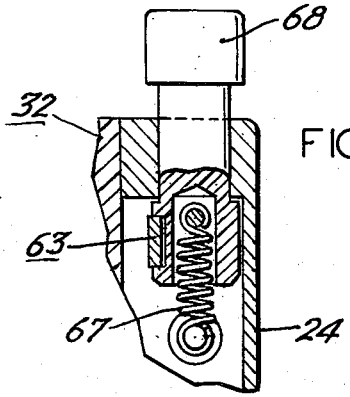
FIG.8.

DISPENSING NOZZLE CONTROL SYSTEM

BACKGROUND OF THE INVENTION

This invention relates to nozzles for dispensing gasoline into vehicle fuel tanks and more specifically to systems for controlling the operation of a dispensing nozzle having a vapor receiving system.

Current environmental regulations require in some areas that gasoline vapors displaced from a vehicle fuel tank while being filled are to be recovered in order to prevent their escape into the atmosphere. One method of complying with this requirement is to have a closed filling system wherein the vapors displaced from the fuel tank are forced back into the underground hydrocarbon storage tanks. Many systems have been designed to recover vapors by this direct displacement method. Most of them include a vapor receiving system surrounding the discharge spout of the nozzle which has a sealing face for making a tight seal against the fillpipe opening and an outlet which is connected to the underground tanks so that the vapors are displaced into the vapor receiving system and back through the vapor return line to the underground tanks. A second system for collecting the vapors is a vacuum assist system which utilizes a vacuum pump in the vapor return line to assist the flow of vapors into the underground tank or other collection facility.

One problem that has arisen in the use of these vapor receiving systems is that once the vehicle fuel tank becomes filled, and the dispensing nozzle automatically shuts itself off, the operator often tries to fill the tank further. These attempts may result in gasoline being pumped back into the vapor receiving system and back to the underground tanks through the vapor return line. This recycling of the gasoline can result in perpetrating a fraud on the customers since the meter on the pump is also operating while gasoline is being pumped back to the underground tanks, thereby possibly indicating that the customer is buying more gasoline than he has actually received and maybe even more than the tank in his vehicle can hold. In addition, leakage of gasoline out through the seal of the vapor receiving system with the fillpipe can increase the risk of fire. Another problem is that the efficiency of vapor recovery is decreased if liquid gasoline is in the vapor return line.

Understanding the reason behind this problem requires an understanding of the operation of the automatic shut-off system used in most nozzles commercially available today. The shut-off system utilizes the pressure differential between two pressure chambers to create differential displacement of a flexible diaphragm separating the two chambers. The position of this diaphragm determines whether or not the actuating lever which is moved to open the main valve of the nozzle, is able to actuate the main valve. In operation, when the pressure in a first chamber falls below a predetermined level, the diaphragm displacement disables the actuating lever so that it can no longer open the main nozzle valve.

The reduced pressure in the first chamber is achieved by having it connected to a vacuum source such as a venturi arrangement in which the vacuum is created by the flow of gasoline through the venturi. As is known by those skilled in the art, this vacuum is relieved through a vent line connected to this first chamber at one end and at the end of the discharge spout at the other end. When the liquid level reaches the end of the spout, the vent tube outlet is covered and the vacuum caused by the venturi cannot be relieved, so the diaphragm is displaced to cause the main valve to close.

However, if the operator desires, he can attempt dispensing of gasoline again since the diaphragm returned back to its normal position when the flow of gasoline stopped because the automatic shut-off system has an inherent time delay before disabling the nozzle again due to the fact that the required vacuum force from the flow of gasoline through the venturi must be created again. Thusly, the operator can initiate gasoline dispensing ad infinitim, causing a certain amount of gasoline to be pumped into the tank each time.

When using a vapor receiving system with the dispensing nozzle, the operator cannot visually ascertain the liquid level in the tank. Therefore, with further attempts to "top off" the tank, a point is reached where gasoline is pumped into the vapor receiving system.

SUMMARY OF THE INVENTION

In accordance with a preferred embodiment, a locking system is provided which operates in conjunction with the control system for a gasoline dispensing nozzle to prevent further dispensing of gasoline after a nozzle has automatically shut itself off. The locking mechanism is designed to preferably be used on most conventional nozzles available today, having a nozzle control system which includes a nozzle valve actuation system for opening and closing the nozzle valve, and an automatic shut-off system operating in response to the liquid level in the container being filled to disable the actuation system so that the nozzle valve closes. The locking mechanism is designed to lock the automatic shut-off mechanism in its disabling position when that position is obtained. A reset mechanism is provided to release the locking mechanism to again enable the actuation system so that further dispensing of gasoline can be commenced. Preferably, the reset mechanism is located in such a position as to make it inconvenient for the operator to continually reset the locking mechanism, so as to discharge excessive attempts to "top off" the tank.

An alternative embodiment utilizes a magnetic means for maintaining the automatic shut-off mechanism in its disabling position when that position is obtained as well as reset means to release the magnetic means.

In order for the operator to top off the tank, he will have to reset the locking mechanism after each time the automatic shut-off system disables the nozzle. Assuming proper instructions to the operator and compliance by the operator, the possibility of the operator overfilling the tank is minimized, as well as the possibility of gasoline being pumped back into the vapor receiving system. The resulting benefits include accurate determination of the quantity of gasoline received by the customer and maintenance of the vapor receiving system in its proper condition.

A better understanding of the invention and its advantages can be seen in the following description of the figures and preferred embodiment.

DESCRIPTION OF THE DRAWINGS AND PREFERRED EMBODIMENT

FIG. 3 is a sectional view taken through the nozzle control system. (Some of the hidden detail has been eliminated to avoid unnecessarily complicating the drawing).

FIG. 4 is a sectional view taken along the lines 4—4 in FIG. 3.

FIG. 5 is a sectional view of FIG. 3 along the line 5—5 illustrating the locking system in its locked positioned.

FIG. 8 is a detailed view of the reset mechanism.

For purposes of illustrating the preferred embodiment of this invention, a dispensing nozzle with a design similar to that illustrated in U.S. Pat. No. 3,734,339 issued to E. T. Young, and a vapor receiving system similar to that disclosed in a copending patent application entitled "Gasoline Dispensing Nozzle With A Vapor Receiving System", by Hansel, filed Sept. 2, 1975, Serial No. 609,761 will be used.

Figure 1:
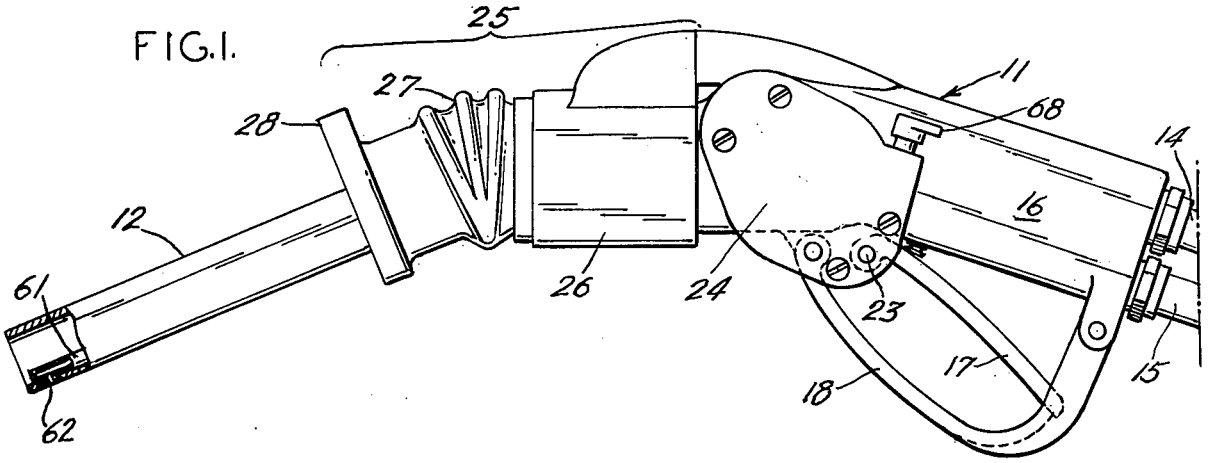
FIG. 1 is a view of a typical dispensing nozzle with a vapor receiving system illustrating its external appearance.
Figure 2:
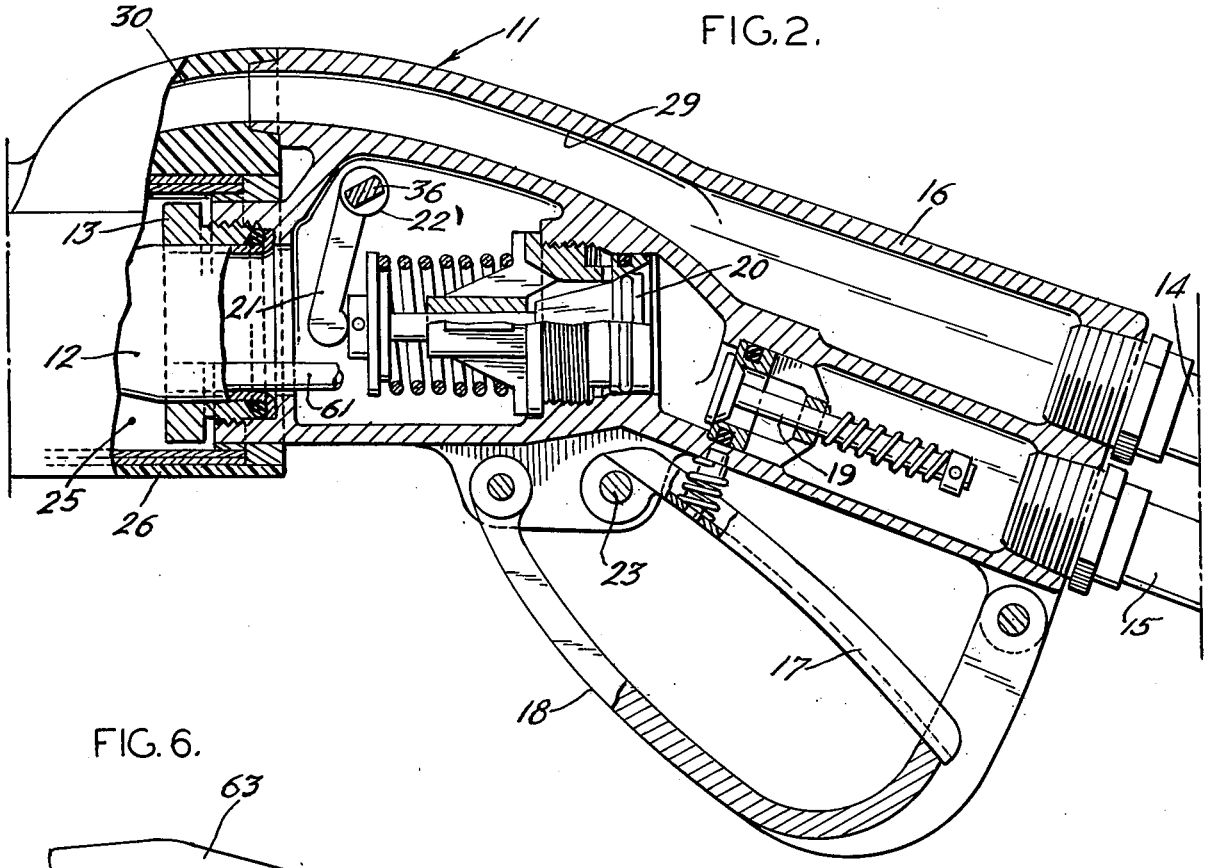
FIG. 2 is a partial sectional view taken through the dispensing nozzle of FIG. 1, illustrating the nozzle valve and fluid passages.

Referring to FIGS. 1 and 2, the basic nozzle and vapor receiving components, other than the nozzle control system components, will be briefly discussed. The nozzle assembly has a housing 11 with a discharge spout 12 connected thereto by retaining nut 13. A vapor return hose 14 and a gasoline supply hose 15 are connected to handle portion 16 of nozzle housing 11. Actuating lever 17 is provided to control dispensing of gasoline through the nozzle. Guard 18 acts to protect actuating lever 17 as well as to provide a support for holding the nozzle when it is inserted into the pump housing for storage when not in use.

Inside housing 11 is a gasoline flow passageway connected to gasoline supply hose 15, in which is included antidrain valve 19 and nozzle valve 20 for controlling the flow of gasoline through the nozzle. Nozzle valve 20 is opened when operating arm 21 on valve shaft 22 is rotated toward nozzle valve 20. Valve shaft 22 is connected to actuator shaft 23 of lever 17 through a nozzle control system which is located behind cover 24 and will be explained in more detail below.

The vapor receiving system has a vapor receiving chamber, generally denoted by the numeral 25, which is formed by a non-flexible housing 26 mounted to nozzle housing 11 on one end, flexible bellows section 27 mounted on the other end of non-flexible housing 26, and a sealing section 28 connected to the free end of bellows 27, for making a tight seal against the fillpipe opening. A vapor return line for vapor receiving chamber 25 includes internal passageway 29 inside nozzle housing 11 connected to non-flexible housing 26 and vapor return hose 14 leading to the underground storage tanks or other container for collecting the vapors. An attitude valve, such as that identified by the numeral 30 in FIG. 2, can be provided at the connection of internal passageway 29 to non-flexible housing 26, so that the vapor return line is closed when the nozzle is not in use to prevent vapors from being displaced from the underground tanks back out into the atmosphere through the vapor receiving system. One attitude valve design which will perform this function is illustrated and discussed in the copending patent application entitled "Attitude Valve For A Gasoline Dispensing Nozzle With A Vapor Receiving System", by Hansel, Ser. No. 609,761, filed Sept. 2, 1975.

The locking system for the control system of the nozzle is designed primarily to operate on those control systems having an automatic shut-off system employing at least one diaphragm which separates two chambers of different pressures in which the movement of the diaphragm a predetermined distance causes the nozzle valve actuation system to be disabled so the gasoline can no longer flow through the nozzle. However, it is understood that the principles of operation behind these locking systems may be equally applicable in other nozzle control systems utilizing a different automatic shut-off system.

The structure of the nozzle valve actuation system for the nozzle control system will now be discussed with reference to FIGS. 3–7. Valve shaft 22 extends outwardly (laterally) from the arm 21, through a bore 33 formed in wall 32 of housing 11. A sleeve bearing is provided for shaft 22 by means of a bushing 34 which surrounds this shaft, within bore 33. A seal is provided for valve shaft 22 by means of O-ring 35 which surrounds this shaft and engages the wall of bore 33, near the outer end of wall 32. This arrangement seals rotatable valve shaft 22 through wall 32 of nozzle housing 11 and prevents leakage of gasoline out of this housing.

Valve shaft 22 extends outwardly (sideways or laterally, in the normal upright position of the nozzle) beyond O-ring 35 and beyond the outer end of wall 32 a suitable distance. The outer end of this shaft (opposite to the inner end thereof, to which end arm 21 is fastened, as previously decribed) is provided with a tang 36. A valve arm 37, which extends generally in a direction at right angles to the axis of shaft 22, has at one end thereof an integral hub 38 having a substantially rectangular opening which fits over tank 36; this fastens valve arm 37 to shaft 22 so that rotation of valve arm 37 will rotate valve shaft 21 opening or closing valve 20. Valve arm 37 is somewhat banjo-shaped, having a large substantially central opening 39, and at its other end (opposite to hub 38) has an integral pin 40 which extends outwardly from the plane of the main portion of the arm.

A rocker arm 41, which is shown to be considerably thicker than valve arm 37, has at one end an elongated slot 42 which receives the outwardly-extending portion of pin 40, to provide a pin-and-slot pivotal connection between valve arm 37 and rocker arm 41. Rocker arm 41 has a substantially central circular hole 43 for receiving a fulcrum pin 58 (to be later described), and has at its other end an elongated slot 44 which receives the inwardly-extending portion of an outstanding pin 45 which is integrally located at one end of actuator arm 46. This latter arm provides a pin-and-slot pivotal connection between rocker arm 41 and actuator arm 46.

Actuator arm 46 lies substantially parallel to valve arm 37 (and also to rocker arm 41). At the end of arm 46, opposite to pin 45, is an integral hub 47 with a substantially rectangular opening which fits over a tang 48 provided on one end of actuator shaft 23.

Operation of the nozzle actuation system is accomplished by moving actuator arm 17 toward handle 16, which causes actuator arm 46 to rotate in a counterclockwise direction with respect to actuator shaft 23. The pin and slot pivotal connection at pin 45 rocker arm 41 to be pivoted in a counterclockwise position about fulcrum pin 58. Valve arm 37 is then rotated in a counterclockwise direction with respect to shaft 22 due to the pin and slot connection at pin 40. Rotation of valve shaft 22 in the counterclockwise direction causes operating arm 21 to be rotated towards nozzle valve 20, thereby causing it to open.

An automatic shut-off system, which is responsive to the presence of liquid gasoline reaching the end of the discharge spout, is also provided as part of the nozzle control system. The automatic shut-off system is designed to disable the valve actuating system by the movement of fulcrum pin 58 into and out of hole 43 in rocker arm 41. When fulcrum pin 58 is in the position illustrated in FIG. 4, it can act as a fulcrum point for the rotation of rocker arm 41. However, when fulcrum pin 58 is in its disabling position, as illustrated in FIG. 5, rocker arm 41 does not have a fulcrum point about which to pivot and therefore cannot rotate to move valve arm 37, despite the movement of actuating lever 17. In this disabling position, the spring in nozzle valve 20 causes valve 20 to remain closed, so that no gasoline is dispensed.

The automatic shut-off system will now be described in more detail, referring to FIG. 4. The side wall 32 of housing 11 has an outwardly-facing annular shoulder 50 which supports the outer ends of the three legs of a three-legged leaf spring 51. Spring 51 is generally Y-shaped, having three legs extending radially outwardly from a central hub area. Spring 51 is normally bowed slightly outwardly at its center (or upwardly as shown in FIG. 4).

Side wall 32 of the casing also has an outwardly-facing annular shoulder 52 (of larger diameter than shoulder 50) for mounting the outer periphery of a flexible impervious diaphragm 53. Diaphragm 53 is made from a suitable material (for example, Neoprene) which is substantially unaffected by gasoline. Diaphragm 53 is sealingly held in position against shoulder 52 by means of a diaphragm mounting or clamping plate 54 a portion of which overlies the outer edge of the diaphragm and which is secured to wall 32 by means of four bolts 55 (see FIG. 3), located beyond the edge of the diaphragm. Between the inner face of the diaphragm 53 and the inner partition which closes off the space within wall 32 there is thus formed an enclosed space or chamber 56 (actually, a volume) which may be termed a low pressure chamber. Clamping plate 54 has apertures spaced around its center so that a reference or high pressure chamber 57 is defined as the space between the outer face of diaphragm 53 and the inside of cover 24.

An outwardly-projecting fulcrum pin 58, whose outer end is normally positioned within hole 43 in the rocker arm 41, is attached to diaphragm 53, for movement thereby, by means of a bolt 59 which passes sealingly through a central hole in diaphragm 53 and which threads into a tapped hole in fulcrum pin 58. The head at the inner end of bolt 59 bears against the central hub area of spring 51. The fulcrum pin 58 is mounted for sliding movement (in the direction of its length) in a rigid support (capable of resisting lateral forces) provided by a sleeve 60 integral with the fixed diaphragm mounting plate 54.

As can be seen from this description, two pressure chambers are provided on either side of diaphragm 53 which are identified as low pressure chamber 56 and reference pressure chamber 57 in FIG. 4. Reference chamber 57 can be allowed to remain at atmospheric pressure. However, because of the increased pressure in a tank being filled with a nozzle having a vapor recovery system, reference chamber 57 is connected to the vapor return line to provide a more reliable operation when using a vapor receiving system. This particular problem and one solution is discussed in more detail in the copending patent application by Hansel, entitled "Automatic Dispensing Nozzle Adapted For Vapor Recovery", Ser. No. 468,841, filed May 10, 1974, now U.S. Pat. No. 3,946,773.

Low pressure chamber 56 is connected to a venturi arrangement which is included in the valve design of main poppet valve 20, by a passageway means (not shown). As is well known by those skilled in the art, the flow of gasoline through the venturi arrangement produces a vacuum of sufficient force to cause diaphragm 53 to be displaced into chamber 56. However, this vacuum force is normally relieved through a vent line 61 connected at one end to chamber 56 and at the other end to an outlet 62 at the end of discharge spout 12.

During normal operation of the nozzle, gasoline is pumped through nozzle valve 20 and the venturi therein, to create a vacuum in low pressure chamber 56, which is relieved through vent tube 61. When the liquid level of the tank being filled reaches outlet 62 of vent tube 61 in the end of spout 12, the relief of the vacuum in chamber 56 is prevented. The vacuum created causes fulcrum pin 58 and diaphragm 53 to be pulled toward the interior of chamber 56 (or in a downward direction as illustrated in FIG. 4). At this time, rocker arm 41 does not have a pivot point and permits valve arm 37 to return to its normal position due to the force of the spring in nozzle valve 20. Since the flow of gasoline through the nozzle has stopped, no vacuum is created in chamber 56 and spring 51 moves fulcrum pin 58 and diaphragm 53 back to its original position.

The problem that is encountered in using nozzles which operate on principles similar to those discussed above is that the force required to shut the nozzle off (the vacuum created by the venturi arrangement) must be created by the flow of gasoline through the nozzle. The problem inherent in this system is that when the gasoline tank becomes filled with gasoline, despite the fact that outlet 62 of the vent tube 91 is covered with gasoline, some gasoline can still be dispensed into the gasoline tank before a sufficient vacuum is developed for the shut-off mechanism to disable the nozzle valve actuation system.

Herein lies the problem to which this invention is directed. Continuous attempts by the operator to pump more gasoline into a tank that is already filled can result in displacing gasoline into the vapor receiving system and back into the vapor return lines. While it is possible that this can be done innocently, it is also possible that a pump operator can create a fraud on the customer by causing him to pay for more gasoline than he is actually receiving. While no system can be made foolproof to thwart an unscrupulous operator, the locking system provided herein serves to discourage the operator from continually trying to pump gasoline into a tank after it is automatically shut off the first time.

One embodiment of the locking system has a locking arm 63 which is pivoted on one end about locking shaft 64 and lies in a plane between and parallel to valve arm 37 and rocker arm 41. Sleeve 60 of clamping plate 54, through which fulcrum pin 58 passes, has an opening or slot 65 passing entirely through part of the side wall of sleeve 60, through which locking arm 63 can pass. Fulcrum pin 58 has a notched shoulder 66 located around the circumference of its outwardly facing or upper side, as illustrated in FIG. 4. Locking arm 63 is biased so that it normally rotates into slot 65 toward fulcrum pin 58 by biasing spring 67 connected to a part of side wall 32 of housing 11. A reset mechanism is provided for rotating locking arm 63 away from slot 65 which includes a knob 68 slidably mounted in cover 24 and connected to the nonpivoted end of locking arm 63.

Figure 6:
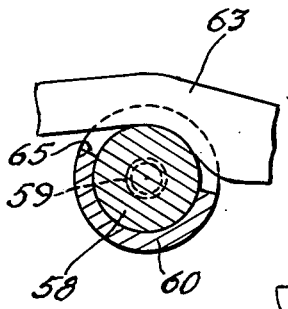
FIGS. 6 and 7 are partial sections of FIG. 5 taken along the line 6—6, illustrating the normal and locked positions of the locking system, respectively.
Figure 7:
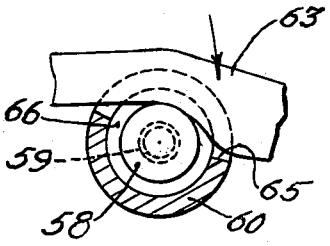
Figure 9:
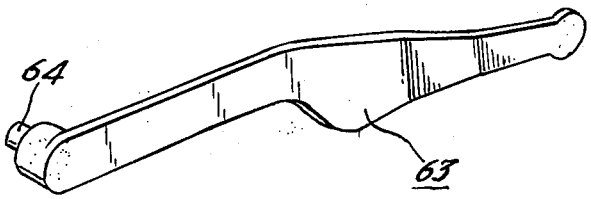
FIG. 9 is an elevational view of the locking arm.

In operation, since locking arm 63 is biased about locking shaft 64 toward fulcrum pin 58, locking arm 63 is pulled through slot 65 and onto shoulder 66 of fulcrum pin 58 when the vacuum force overcomes the force of spring 51 and pulls fulcrum pin 58 into sleeve 60, out of engagement with rocker arm 41. The vacuum within chamber 56 is relieved once nozzle valve 20 closes, however, fulcrum pin 58 is prevented from returning to its original position in engagement with rocker arm 41 by the contact of locking plate 63 against shoulder 66, as is shown in FIGS. 5 and 7. At this time, further dispensing of gasoline is prevented since rocker arm 41 has no pivot point. In order to be able to dispense more gasoline, the operator must reset the locking mechanism by pulling knob 68 upward and away from nozzle valve control system cover 24. This action then permits spring 51 to return fulcrum pin 58 back into its original position, and locking plate 63 again rests against the side of pin 58, as shown in FIGS. 4 and 6.

For purposes of minimizing the effect of the locking system on the normal operation of the nozzle systems, it is desirable to arrange the relationship between locking plate 63 and pin 58 so that the frictional force exerted on pin 58 by plate 63 does not greatly increase the vacuum force required to displace diaphragm 53 and pin 58. One method of accomplishing this result is to keep the surface area of locking plate 63 resting on pin 58 to a minimum. An additional feature is to have plate 63 resting on a beveled portion of pin 63 as opposed to the lateral side of pin 63, as is shown in FIG. 4. This particular placement of plate 63 acts to divide the force exerted by plate 63 and spring 67 so that the radial force on pin 63 is reduced.

Figure 10:
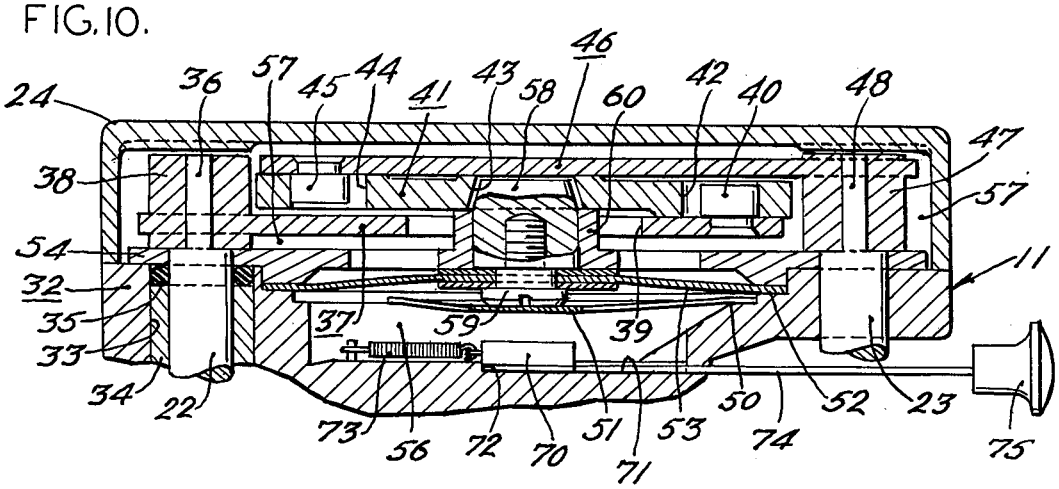
FIG. 10 is a sectional view similar to FIG. 4, showing the alternative embodiment in schematic form.
Figure 11:
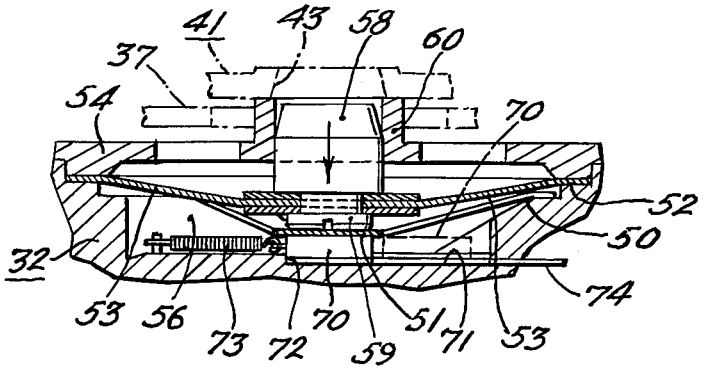
FIG. 11 is a partial view of FIG. 10, illustrating the locking system in its locking position.

Other variations on the locking system are possible to provide the same function. One alternative to the locking plate embodiment is illustrated in FIGS. 10 and 11. This embodiment utilizes magnetic means to maintain the automatic shut-off system in its disabling position.

In this alternative embodiment, a magnet 70 is positioned beneath bolt 59 (as shown in FIG. 10), which secures fulcrum pin 58 to diaphragm 53. Bolt 59 is selected to be made from a ferrous material or other magnetically attractable material. The distance between magnet 70 and bolt 59 and the strength of magnet 70 are selected so that bolt 59 is not attracted to magnet 70 until the automatic shut-off system is actuated, moving bolt 59 against magnet 70, wherein the magnetic force of magnet 70 is sufficient to maintain diaphragm 53 and fulcrum pin 58 in their actuated positions.

A reset system to release bolt 59 can be designed in several ways. One system may include a mechanical means to push bolt 59 away from magnet 70. Another system, shown in FIG. 10, uses a means to displace magnet 70 away from bolt 59. In this system, magnet 70 is slidably mounted in a groove 71 with a stop 72 located so that when magnet 70 is positioned against the stop, it is correctly in place under bolt 59. Compression spring 73 is provided to normally bias magnet 70 against stop 72. Connecting link 74 extends out of chamber 56 to reset button 75 so that magnet 70 can be pulled away from bolt 59, as shown in phantom in FIG. 11, to permit the automatic shut-off system to return to its normal position.

As can be seen from this description of locking systems, the extra requirement of resetting the nozzle valve control system by unlocking the automatic shut-off system acts to remind the operator not to overfill the tank. While this locking mechanism cannot absolutely prevent overfilling of a tank by an operator intent on doing so, it does inconvenience the operator a sufficient amount to deter most operators from trying to overfill the tank.

While a particular embodiment of this invention has been shown and described, it is obvious that changes and modifications can be made without departing from the true spirit and scope of the invention. It is the intention of the appended claims to cover all such changes and modifications.

The invention claimed is:

1. In a dispensing nozzle for filling a tank with a liquid, and having,
   a. a nozzle valve,
   b. means for actuating the nozzle valve into an open or a closed position; and
   c. automatic shut-off means, responsive to the liquid in the tank reaching a predetermined level, for placing the actuating means in a disabled condition wherein the nozzle valve cannot be actuated, said shut-off means having an enabling mode wherein the actuating means can actuate the nozzle valve and a disabling mode wherein the actuating means cannot actuate the nozzle valve;
   an improvement for preventing the further dispensing of liquid by the nozzle once the tank liquid level has reached its predetermined level, said improvement comprising:
   d. means, responsive to the automatic shut-off means obtaining its disabling mode, for maintaining the actuating means in the disabled condition so that the nozzle valve cannot be actuated by the actuating means; and
   e. means for resetting the maintaining means to its normal position wherein further dispensing of liquid is permitted until the automatic shut-off means and the maintaining means is actuated again.

2. The improvement for a dispensing nozzle recited in claim 1, wherein the maintaining means comprises means for locking the automatic shut-off means in its disabling mode, said locking means having a first position wherein normal operation of the actuating means is permitted and a second position wherein the automatic shut-off means is locked in its disabling mode to prevent the actuating means from actuating the nozzle valve.

3. The improvement for a dispensing nozzle recited in claim 2, wherein the automatic shut-off means includes,
   a. at least one pressure chamber;
   b. means for reducing the pressure in the pressure chamber below a predetermined level;

c. means for relieving the reduced pressure in the pressure chamber at all times except when the liquid reaches the predetermined level in the tank; and d. means, responsive to the pressure in the pressure chamber falling below a predetermined level, for disabling the actuating means; and the locking means comprises:

e. means for holding the disabling means in its disabling mode so that in its first position the normal operation of the disabling means is permitted and in the second position, the disabling means is held in its disabling mode to prevent the actuating means from actuating the nozzle valve.

4. The improvement for a dispensing nozzle recited in claim 3, wherein the disabling means further includes, a. a flexible diaphragm, the amount of displacement of a selected portion of the diaphragm being indicative of the pressure in the pressure chamber; and b. a rigid pin member secured to the selected portion of the diaphragm, the displacement of said pin member into and out of engagement with the actuating means being determinative of the enabling and disabling of the actuating means; and the holding means comprises:

c. means, responsive to the pin member being displaced into position for disabling the actuating means, for securing said pin member into the position for disabling the actuating means.

5. The improvement for a dispensing nozzle recited in claim 4, wherein the rigid pin member has a catching means located on its body and the securing means comprises:

a. a locking arm, pivotally mounted on the nozzle; and b. means for biasing the arm into contact with the rigid member so that when the pin member is displaced a sufficient distance to be out of engagement with the actuating means, the locking arm engages the catching means and maintains the pin member in this position to prevent further dispensing of gasoline until reset by the resetting means.

6. The improvement for a dispensing nozzle recited in claim 5, wherein the rigid pin member has a section beveled away from the side of the pin member toward its center and the catching means is a circumferential shoulder located in the beveled section of the pin member, and wherein the improvement is arranged so that the locking arm rests on the beveled section of the pin member when the automatic shut-off system and the pin member are in their normal position and so that when the automatic shut-off system is actuated to disable the nozzle valve actuating means, the locking arm contacts the shoulder to prevent the pin member from returning to its normal position to enable the nozzle valve actuating means.

7. The improvement for a dispensing nozzle recited in claim 1, wherein the maintaining means is magnetic.

8. The improvement for a dispensing nozzle recited in claim 7, wherein the automatic shut-off means includes a movable, magnetically attractable member having a first position wherein the shut-off means is in its enabling mode and a second position wherein the shut-off means is in its disabling mode; and wherein the magnetic means comprises a magnet located in relation to the magnetically attractable member so that when the member is in its first position, insufficient magnetic force is available to attract the member and when the member is in its second position, sufficient magnetic force acts on the member to maintain it in its second position; and wherein the resetting means comprises means for allowing the magnetically attractable member to overcome the magnetic force to return to its first position.

9. The improvement for a dispensing nozzle recited in claim 8, wherein the magnetic means is movable and the allowing means comprises means for moving the magnetic means away from the magnetically attractable member so that insufficient magnetic force is available to maintain the member in its second position.

* * * * *